United States Patent [19]

Eichenberger et al.

[11] Patent Number: 4,677,710

[45] Date of Patent: Jul. 7, 1987

[54] ARRANGEMENT FOR CLEANING THE PRESSING ROLLERS OF A COMBING MACHINE

[75] Inventors: Hansulrich Eichenberger, Winterthur; Ludwig Lacher, Wetzikon; Titus Schmid, Winterthur, all of Switzerland

[73] Assignee: Maschinenfabrik Rieter A.G., Winterthur, Switzerland

[21] Appl. No.: 731,482

[22] Filed: May 7, 1985

[30] Foreign Application Priority Data

May 7, 1984 [CH] Switzerland ..... 2219/84

[51] Int. Cl.[4] ..... D01C 19/22

[52] U.S. Cl. ..... 19/218; 19/231; 19/265

[58] Field of Search ..... 19/218, 265, 115 R, 19/215, 218, 229, 231, 262, 264

[56] References Cited

U.S. PATENT DOCUMENTS

| | | | |
|---|---|---|---|
| 464,718 | 12/1891 | Thorp | 19/218 |
| 1,074,294 | 9/1913 | Rooney | 19/218 |
| 1,649,322 | 11/1927 | Perutz | 19/262 |
| 2,389,684 | 11/1945 | Pierrepont | 19/218 |
| 2,391,754 | 12/1945 | Thoma | 19/265 X |
| 2,673,375 | 3/1954 | Snyder | 19/218 |
| 2,787,811 | 4/1957 | Klein | 19/265 |
| 3,059,284 | 10/1962 | Naegeli | 19/265 X |
| 3,340,577 | 9/1967 | Morrow et al. | 19/265 X |
| 3,577,845 | 5/1971 | Eichenberger et al. | 19/231 |

*Primary Examiner*—Louis K. Rimrodt

*Attorney, Agent, or Firm*—Michael J. Striker

[57] ABSTRACT

A cleaning arrangement for the pressing rollers of a combing machine which are pressed toward associated detaching rollers includes at least one cleaning roller which is mounted for free rotation in engagement with the respective pressing roller about an axis parallel to that of such pressing roller. The cleaning roller has a smooth outer surface to which fibers will not adhere. During the operation of the combing machine, the pressing rollers conduct controlled intermittent rotary movements, but the cleaning roller does not immediately follow such movements; rather, a certain degree if slippage occurs between the cleaning roller and the respective pressing roller, resulting in striping off of any fibers which may adhere to the pressing roller. Such detached fibers than fall onto the fibrous web being combed, which passes between the pressing rollers and the associated detaching rollers but, because of the relatively small quantity of such detached fibers, the quality of the web does not suffer to any appreciable extent.

11 Claims, 2 Drawing Figures

ARRANGEMENT FOR CLEANING THE PRESSING ROLLERS OF A COMBING MACHINE

BACKGROUND OF THE INVENTION

The present invention relates to an arrangement for cleaning rollers in textile industry in general, and more particularly to a cleaning arrangement for use in a combing machine for cleaning the pressing rollers which are pressed toward the associated detaching rollers.

There are already known various constructions of combing machines, among them such which include two pressing rollers which are situated at least approximately at the same elevation adjacent each other and upwardly of the detaching roller toward or against which they are being pressed. It is well known to those active in this field that waste particles or formations, expecially individual fibers, adhere to the detaching rollers and to the associated pressure rollers in combing machines. This waste material must be removed. Cleaning rollers or cleaning plates provided with a plush coating or layer are currently being usually used for cleaning the pressing rollers. In this instance, the fibers and other waste materials become caught in the plush material and are retained thereby. This, however, brings about the disadvantage that the plush material has to be periodically cleaned to remove the retained waste material therefrom and thus to restore the cleaning ability of this material. One of the main reasons why this approach is disadvantageous is because the cleaning of the plush material must be generally performed approximately every two hours and involves a considerable amount of work on the part of the operating personnel, which makes this approach quite wasteful, difficult to perform, and uneconomical.

SUMMARY OF THE INVENTION

Accordingly, it is a general object of the present invention to avoid the disadvantages of the prior art.

More particularly, it is an object of the present invention to provide a cleaning arrangement for the pressing rollers of a combing machine, which arrangement does not possess the disadvantages of the conventional arrangements of this type.

Still another object of the present invention is so to construct the cleaning arrangement of the type here under consideration as to be able to perform the cleaning action on a continuous basis, without interrupting the operation of the combing machine from time to time for removal of the accumulated waste material.

It is yet another object of the present invention so to design the arrangement of the above type as to be able to easily install it on an existing combing machine.

A concomitant object of the present invention is to develop a cleaning arrangement of the above type which is simple in construction, relatively inexpensive to manufacture, easy to use, and reliable in operation nevertheless.

In pursuance of these objects and others which will become apparent hereafter, one feature of the present invention resides in an arrangement for use in a combing machine for cleaning a pressing roller that is pressed toward an associated detaching roller, this cleaning arrangement comprising a cleaning roller having a smooth outer surface adverse to adhesion of fibers thereto; and means for mounting the cleaning roller for free rotation in engagement with the pressing roller about an axis parallel to that of the latter, the surface quality of the cleaning roller and of the pressing roller being such that slippage occurs during the operation of the combing machine between the cleaning roller and the pressing roller.

Experience with the cleaning arrangement constructed in accordance with the present invention has shown that fibers do not adhere or cling either to the pressing rollers or to the cleaning rollers, that is, that the cleaning roller is self-cleaning. In this manner, the otherwise existing need for periodic cleaning of the cleaning rollers or cleaning plates of the conventional constructions of the cleaning arrangements is eliminated or avoided by constructing the cleaning arrangement in accordance with the invention. The cleaning effect with respect to the pressing rollers, and the self-cleaning effect as far as the cleaning roller is concerned, comes into being because, in combing machines, the detaching rollers and pressing rollers are rotated forward and backward, that is, in opposite senses of rotation, during the operation of the combing machine, the commencement of the respective rotational movement being jerky in character. Thus, upon each change in the direction and/or speed of the rotational movement, slippage occurs between the pressing roller and the cleaning roller, inasmuch as the latter is freely rotatable and, because of its special characteristics or qualities, is not instantaneously carried along by the outer circumferential surface of the pressing roller. This relative slippage results in a scraping and a stripping effect. Consequently, the fibers fall from the pressing and cleaning rollers as individual fibers or small fiber tufts. It is particularly advantageous in the cleaning arrangement according to the present invention that the so falling fibers land on the fibrous web being combed or processes which extends between the adjacent pairs of pressing and detaching rollers. Since only a relatively small quantity of fibers is involved, the quality of the web does not suffer as a result.

It is particularly advantageous, when the arrangement of the present invention is used in a combing machine in which an additional pressing roller is arranged parallel to and substantially at the same elevation as the pressing roller mentioned before, when the cleaning roller also engages, in addition to the pressing roller, the additional pressing roller, due to its own weight. Advantageously, the mounting means for the cleaning roller includes respective guides arranged at the longitudinal ends of the cleaning roller and mounting the cleaning roller thereat for the free rotation.

According to another advantageous aspect of the present invention, the weight of the cleaning roller is so selected as to achieve the desired degree of slippage between the cleaning roller and pressing roller during the operation of the combing machine. It is further advantageous when the cleaning roller is made, at least at the outer surface thereof, of an elastomeric material, especially of natural rubber, nitrile rubber, or soft polyvinyl chloride, In this respect, it is particularly advantageous when the cleaning roller includes, at the outer surface thereof, a layer of a material with a hardness of between 65 and 70 degrees on the Shore scale. Advantageously, the cleaning roller and the pressing roller are of the same material at least at the outer surfaces thereof. It is also advantageous when the cleaning roller includes a core with a predetermined weight which determines the engagement pressure between the cleaning roller and the pressing roller and thus the degree of slippage therebetween during the operation of the combing machine. In this manner, there is obtained a very simple and yet effective cleaning arrangement.

The novel features which are considered as characteristic of the invention are set forth in particular in the appended claims. The improved cleaning arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
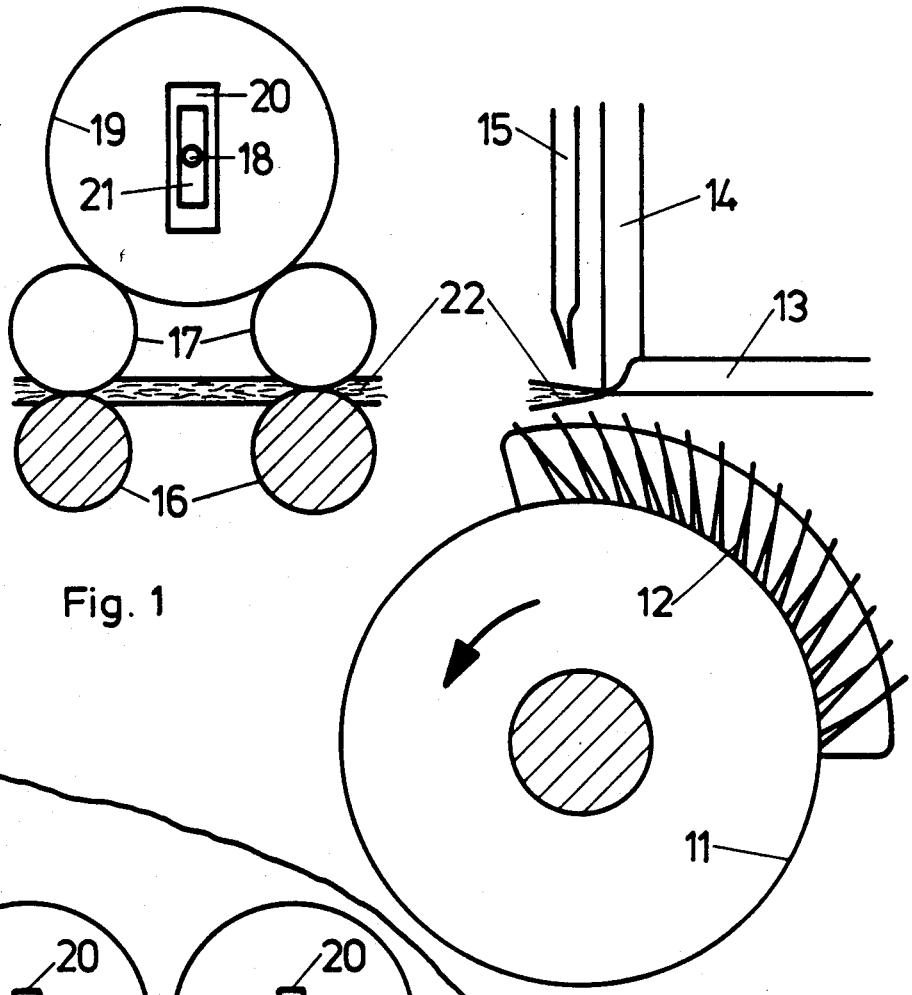
FIG. 1 is a somewhat diagrammatic side elevational view of a portion of a combing machine equipped with the cleaning arrangement of the present invention.

Referring now to the drawing in detail, and first to FIG. 1 thereof, it may be seen that the reference numeral 11 has been used therein to identify a combing roller of a combing machine which is of a conventional construction in all other details but those relating to the present invention, so that it has been shown in the drawing only diagrammatically. The combing roller 11 includes combing needles 12 which are arranged over a part of the periphery of the combing roller 11. Adjacent to the combing roller 11, there is arranged a lower nipper 13, and upper nipper 14 and, adjacent thereto, a fixed comb 15. Furthermore, two detaching rollers 16, and two pressing rollers 17 are provided, being arranged in pairs with the respective pressing roller 17 being pressed toward the associated detaching roller 16. The pressing rollers 17 and the detaching rollers 16 are arranged for rotation about axes that are parallel to one another.

A cleaning roller 19 is arranged to rest on the pressing rollers 17 in engagement therewith. The cleaning roller 19 is freely rotatable about its longitudinal axis 18. The cleaning roller 19 is made, at least at the outer surface thereof, of a material which is adverse to the adhesion or clinging of fibers thereto, that is, to which such fibers will not adhere or cling and from which such fibers will become detached and fall away easily. The cleaning roller 19 has a smooth, polished outer surface. The cleaning roller 19 is mounted at each of its axial ends in a guide 20 which is spaced from the other guide 20 in the axial or longitudinal direction of the cleaning roller 19. The guides 20 permit free upward and downward movement of the axes 18 within the limits of a vertical slot 21 provided in each of the guides 20, with attendant commensurate movement of the cleaning roller 19.

A band-like web 22 of fibrous textile material to be combed or being combed is held between the associated pressing and detaching rollers 17 and 16 of each of the roller pairs, and between the nippers 13 and 14, as is well known. The arrangement formed by the nippers 13 and 14 and the fixed comb 15 is movable toward the illustrated right-hand pair of the pressing and detaching rollers 17 and 16 and back into the illustrated position.

During the operation of the combing machine, and as the nippers 13 and 14 perform the above-mentioned movement, the web 22 held by the nippers 13 and 14 is passed to the right-hand roller pair consisting of the pressing roller 17 and the detaching roller 16 as considered in FIG. 1 of the drawing. The detaching rollers 16 and the pressing rollers 17, on their part perform intermittent rotary movements in both rotation directions during the combing operation, these rotary movements being performed in a well known manner in a timed relationship to the back and forth movements of the components 13, 14 and 15 of the combing machine. In currently available combing machines, approximately 350 combing strokes are effected per minute during the normal operation of the combing machine. Consistently therewith, the same number of the rotational back and forth movements of the detaching rollers 16 and of the pressing rollers 17 is performed per minute in each of the rotational directions. Therefore, the mode of operation of the combing machine requires that the rotational movements of the pressing rollers 17 have a jerky or abrupt character. The result of this is, as far as the present invention is concerned, that the cleaning roller 19 slips on the associated pressing roller 17 during each change in the rotational direction of the pressing roller 17, due to the inherent inertia of the cleaning roller 19 and the fact that it is brought into movement only by the frictional contact thereof with the associated pressing roller 17, in this instance with the two pressing rollers 17. As a result of this slippage, the cleaning roller 19 strips any fibers which may cling to the pressing roller 17 from the latter. The stripped fibers then fall onto the web 22 and are carried along by the same. The quantity of the stripped fibers is relatively small so that the so deposited fibers, for all intents and purposes, have no effect on the quality of the web 22. This results in the advantnage that periodic cleaning of the cleaning roller 19 becomes superfluous.

Figure 2:
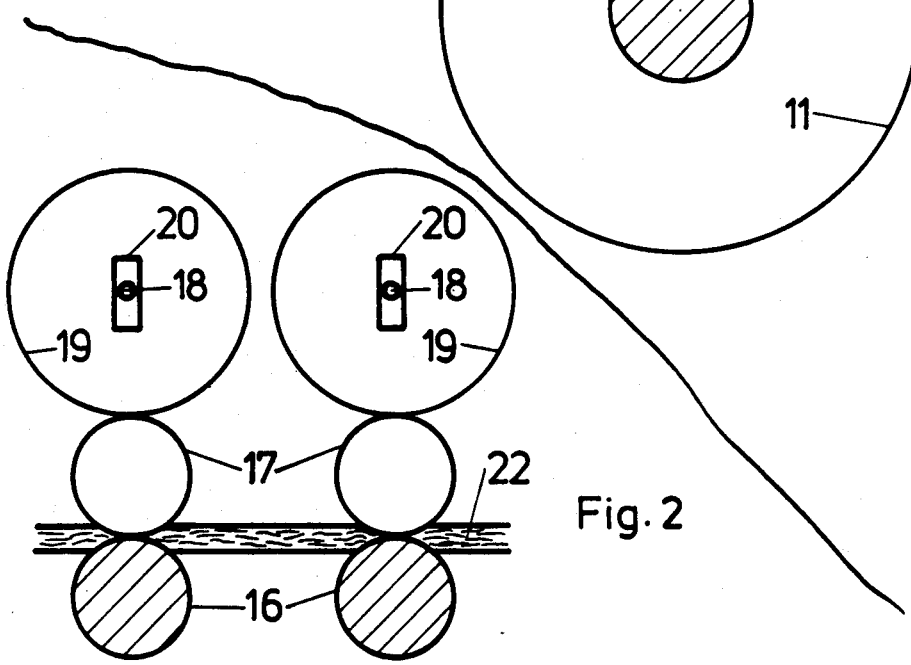
FIG. 2 is a view similar to that of FIG. 1 but showing a modified construction of the cleaning arrangement.

In the modified construction of the cleaning arrangement which is depicted in FIG. 2 of the drawing, there are again provided two detaching rollers 16 and two pressing rollers 17, again arranged in respective pairs. The detaching and pressing rollers 16 and 17 hold the web 22 between themselves and advance the web 22 from left to right, as is well known in this field. A separate cleaning roller 19 is provided for each of the pressing rollers 17. These cleaning rollers 19 are also mounted for free rotation about their respective longitudinal axes. The mounting is effected, in this instance as well, by respective guides 20 which are constructed in the manner described above. Here again, the guides 20 are provided with vertically extending elongated slots which receive the axles 18 of the respective cleaning rollers 19 and permit them to be displaced in the vertical directions, with attendant commensurate movement of the respective cleaning rollers 19. The above-discussed combing roller 11, the nippers 13 and 14, and the fixed comb 15 have been omitted from FIG. 2 of the drawing.

During the operation of the cleaning arrangement illustrated in FIG. 2 of the drawing, slippage also takes place between the respective cleaning rollers 19 and the associated pressing rollers 17 which are engaged by such cleaning rollers 19, this slippage occuring during or immediately following the reversal in the rotational movement of the pressing rollers 17. In this manner there is again obtained stripping of the fibers which may adhere to the respective pressing rollers 17. In this construction of the cleaning arrangement of the present invention as well, the stripped fibers fall onto the web 22, so that the heretofore required periodic cleaning of the cleaning rollers is no longer necessary.

In connection with the use of the present invention, it is important that the slippage of the cleaning roller 19 with respect to the pressing roller 17 occurs in a predetermined desired manner. Consequently, the frictional coefficients of the pressing and cleaning rollers 17 and 19, and the contact pressure between the pressing and cleaning rollers 17 and 19, must be so selected that, upon the reversal in the rotational movement of the pressing roller 17, a predetermined amount of slippage occurs between the cleaning roller 19 and the associated pressing roller 17, that is that the cleaning roller 19 is delayed as far as its following the rotational movement of the associated pressing roller 17 is concerned or, in other words, that slippage occurs between the pressing roller 17 and the cleaning roller 19 immediately upon the reversal in the sense of the rotational movement of the pressing roller 17 or an abrupt acceleration or deceleration thereof.

The degree of the slippage can be influenced in the following ways:

(a) The weight of the pressure roller 19, or its contact pressure, can be correspondingly chosen, for instance, by appropriate selection of the material of the cleaning roller 19 or by the provision of a core of a selected weight in the interior of the cleaning roller 19.

(b) The material at the outer surface of the cleaning roller 19 can be selected in such a manner that the coefficient of friction between the pressure and cleaning rollers 17 and 19 is of such a magnitude that slippage takes place to the desired degree. It has been found to be advantageous in this respect to use the same material for the manufacture of the cleaning rollers 19 as for the manufacture of the pressure rollers 17. In general, natural rubber, nitrile rubber, or soft polyvinyl chloride are currenly contemplated for the cleaning rollers 19 or their outer layers at the very least. However, other elastomeric or elastic materials can be used for this purpose as well.

(c) The elasticity of the material of the cleaning roller 19 is also important. A hardness of the cleaning roller 19 at its outer surface of between 65 and 70 degrees on the Shore hardness scale has been found to be particularly advantageous in terms of the obtained results.

In actual practice, excellent results have been obtained by using the cleaning arrangement as depicted in FIG. 1 in a combing machine operating with 350 combing strokes per minute. The length of the pressing and cleaning rollers 17 and 19 amounted to 34 centimeters. The cleaning roller 19 had a diameter of 5 centimeters and its weight was 350 grams. Both the pressing and cleaning rollers 17 and 19 had an outer surface layer of nitrile rubber. Additionally, the surfaces of the cleaning and pressing rollers 19 and 17 were polished in the manner which is commonplace for treating the pressure rolls of spinning machines.

It will be understood that each of the elements described above, or two or more together, may also find a useful application in other types of arrangements differing from the type described above.

While the invention has been illustrated and described as embodied in a cleaning arrangement for the pressing rollers of a combing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. An arrangement for use in a combing machine for cleaning a pressing roller that is pressed toward an associated detaching roller, comprising a cleaning roller; and means for mounting said cleaning roller for free rotation in engagement with the pressing roller about an axis parallel to that of the latter, the surface quality of said cleaning roller and the pressing roller being such that, during the operation of the combing machine, slippage occurs between said cleaning roller and the pressing roller, said cleaning roller having a smooth outer surface adverse to adhesion of fibers thereto, so that fibers do not adhere to said outer surface of said cleaning roller and cleaning of the latter is not necessary.

2. The arrangement as defined in claim 1 for use in a combing machine in which an additional pressing roller is arranged parallel to and substantially at the same elevation as the pressing roller, wherein said cleaning roller also engages, in addition to the pressing roller, the additional pressing roller, due to its own weight.

3. The arrangement as defined in claim 1, wherein said mounting means for said cleaning roller includes respective guides arranged at the longitudinal ends of said cleaning roller and mounting the latter thereat for said free rotation.

4. The arrangement as defined in claim 1, wherein the weight of said cleaning roller is so selected as to achieve the desired degree of slippage between said cleaning roller and the pressing roller during the operation of the combing machine.

5. The arrangement as defined in claim 1, wherein said cleaning roller is made of an elastomeric material at least at said outer surface thereof.

6. The arrangement as defined in claim 5, wherein said elastomeric material is natural rubber.

7. The arrangement as defined in claim 5, wherein said elastomeric material is nitrile rubber.

8. The arrangement as defined in claim 5, wherein said elastomeric material is soft polyvinyl chloride.

9. The arrangement as defined in claim 1, wherein said cleaning roller includes, at said outer surface thereof, a layer of a material with a hardness of between 65 and 70 degrees on the Shore scale.

10. The arrangement as defined in claim 1, wherein said cleaning roller and the pressing roller are of the same material at least at the outer surfaces thereof.

11. The arrangement as defined in claim 1, wherein said cleaning roller includes a core with a predetermined weight which determines the engagement pressure between said cleaning roller and the pressing roller and thus the degree of slippage therebetween during the operation of the combing machine.

* * * * *